US008783785B2

(12) United States Patent
Lehnert et al.

(10) Patent No.: US 8,783,785 B2
(45) Date of Patent: Jul. 22, 2014

(54) CHISEL HOLDER HAVING A WELD AS A WEAR PROTECTION ELEMENT

(75) Inventors: Thomas Lehnert, Oberraden (DE); Christian Berning, Zülpich (DE); Martin Lenz, Grossmalscheld (DE)

(73) Assignee: Wirtgen GmbH (DE)

( * ) Notice: Subject to any disclaimer, the term of this patent is extended or adjusted under 35 U.S.C. 154(b) by 290 days.

(21) Appl. No.: 13/061,790

(22) PCT Filed: Jul. 10, 2009

(86) PCT No.: PCT/EP2009/005009
§ 371 (c)(1),
(2), (4) Date: May 13, 2011

(87) PCT Pub. No.: WO2010/025788
PCT Pub. Date: Mar. 11, 2010

(65) Prior Publication Data

US 2011/0204702 A1 Aug. 25, 2011

(30) Foreign Application Priority Data

Sep. 5, 2008 (DE) ..... 10 2008 045 825

(51) Int. Cl.
*E21C 35/183* (2006.01)

(52) U.S. Cl.
USPC ..... 299/105; 299/104; 299/106

(58) Field of Classification Search
USPC ..... 299/104, 105, 106
See application file for complete search history.

(56) References Cited

U.S. PATENT DOCUMENTS

| | | | | | |
|---|---|---|---|---|---|
| 1,835,701 | A | * | 12/1931 | Edmunds | 299/105 |
| 1,965,950 | A | * | 7/1934 | Walker | 299/105 |
| 4,091,692 | A | * | 5/1978 | Wrulich et al. | 299/105 |
| 4,159,746 | A | | 7/1979 | Wrulich et al. | |
| 4,932,723 | A | | 6/1990 | Mills | |
| 5,251,964 | A | * | 10/1993 | Ojanen | 299/104 |
| 6,585,327 | B2 | | 7/2003 | Sollami | |
| 6,592,304 | B1 | | 7/2003 | Kammerer | |
| 2002/0070602 | A1 | | 6/2002 | Sollami | |
| 2011/0241407 | A1 | * | 10/2011 | Fader et al. | 299/104 |

FOREIGN PATENT DOCUMENTS

| | | | | |
|---|---|---|---|---|
| DE | 2931785 | A1 | | 2/1981 |
| DE | 3929609 | A1 | | 4/1990 |
| DE | 19924683 | A1 | | 11/2000 |
| EP | 412287 | A | * | 2/1991 |
| GB | 2055928 | A | | 3/1981 |

* cited by examiner

*Primary Examiner* — John Kreck
(74) *Attorney, Agent, or Firm* — Waddey & Patterson, P.C.; Lucian Wayne Beavers

(57) ABSTRACT

The invention relates to a bit holder (20) for a cutting machine, road milling machine, surface miner, or the like, having a bit receptacle (29) that comprises an introduction opening, and having a bit supporting surface (26), at least one wear protection element (40) being arranged in a region associated with the bit supporting surface (26). In order to bring about effective wear protection with little outlay in a bit holder of this kind, provision is made according to the present invention that the at least one wear protection element is embodied as a weld (40), and is arranged at least locally in at least one recess (41).

9 Claims, 14 Drawing Sheets

CHISEL HOLDER HAVING A WELD AS A WEAR PROTECTION ELEMENT

The invention relates to bit holders for a cutting machine, road milling machine, surface miner, or the like, having a bit receptacle that comprises an introduction opening, and having a bit supporting surface, at least one wear protection element being arranged in a region associated with the bit supporting surface.

A bit holder of this kind is known from U.S. Pat. No. 6,585,327 B2. Here the bit holder has an aperture as a bit receptacle; the bit can be inserted exchangeably into said aperture. Provided in the region of the aperture entrance is a respective aperture enlargement into which carbide metal rings are soldered. The bit receptacle is aligned with the apertures passing through the carbide metal rings. The bit inserted into the bit receptacle is braced with its bit head on a bit supporting surface of the facing carbide metal ring.

At the same time, both carbide metal rings also support the bit in the region of its bit shaft, and thus act as wear protection during operational use. The use of carbide metal material for the above-described purpose makes the production outlay considerably more costly.

In addition to the high material price, accurately fitted dimensioning of the receptacles and absolutely aligned securing of the carbide metal rings with reference to the bit receptacle, embodied as an aperture, are necessary. Securing is accomplished by soldering. The energy use required is thus high, and thermal stresses are introduced into the bit holder in the soldering furnace. Even without these stresses, however, large-area carbide metal parts tend to break very easily because of their extreme brittleness. In individual cases in the existing art, multiple carbide metal inserts of smaller dimensions have therefore been installed on bit holders, as indicated by U.S. Pat. No. 5,251,964. This further increases the production outlay needed for precise mutual arrangement and orientation of the carbide metal elements.

Also known, from DE 39 29 609 A1, is a method in which that bit supporting surface of the bit holder which is affected by wear is protected by means of a hard facing made of wear-resistant material. In this context, a powder mixed from carbide metal particles and solder particles is melted onto the surface to be protected. A disadvantage here is that an uneven surface results, which also is not exactly orthogonal to the longitudinal center axis of the bit receptacle. The rotation behavior of the bit is then negatively affected, however, by surface protection of this kind.

It is an object of the invention to create a bit holder of the kind mentioned initially that is protected, effectively and with little outlay in terms of parts and production, from the wear effect of the bit.

This object is achieved in that the at least one wear protection element is embodied as a weld, and is arranged at least locally in at least one recess.

The weld is formed by a filler metal material that can be introduced with little production outlay into the recess by means of a usual welding method. The weld is notable for a high resistance to abrasion, and thus presents a high degree of wear resistance to the bit or the wear protection washer. The wear properties of the bit holder can be adjusted over a wide range by selection of the suitable filler metal material. Wear-optimized bit holder can thus be made available for a variety of road surfaces (concrete, asphalt) or raw materials (coal, sandstone, salt, etc.) that are to be processed.

Because the weld is received in a recess separately provided therefor, surfaces that are required for correct tool function and a long service life remain uninfluenced by the wear element.

According to a preferred variant of the invention, provision can be made for the recess to be embodied as a groove. The groove can easily be introduced into the bit holder, for example, by mechanical machining. Depending on the desired wear properties, almost any groove geometries can be produced. Wear can be controlled by selecting a groove cross section suitable for the intended application.

Provision can be made, for example, that the bit supporting surface extends annularly around the introduction opening and is arranged orthogonally to the longitudinal center axis of the bit receptacle; and that the recess is recessed into the bit supporting surface. The bit supporting surface, which as a geometrical element of the bit holder guarantees precise bracing of the bit, is not functionally impaired by the groove. The degree to which the groove is recessed can be selected in material-optimized fashion so that the wear limit for the bit holder is reached when the entire weld is worn away.

If provision is made that the weld terminates flush with the bit supporting surface, the weld then does not influence precise bit bracing but is available immediately for entry into service. Alternatively, provision can also be made that the weld is arranged at least locally with a setback in the direction of the longitudinal center axis of the bit receptacle with respect to the bit supporting surface.

This permits the bit to wear away against the bit holder over a limited time period beginning at entry into service. These components can thereby find their working positions. The wear protection effect of the weld then begins, or increases. A further advantage is the simplicity of producing the weld.

In order to reliably ensure free rotatability of the bit with respect to the bit holder, provision can be made that the recess extends around the introduction opening.

One possible configuration of the invention can be such that the groove comprises a bottom wall and two groove walls laterally adjoining it at an angle; and that the groove side walls are parallel to one another. A constant wear resistance is then presented over the entire working life of the weld.

It is also conceivable, however, for the groove to have a bottom wall and two groove side walls each laterally adjoining it at an angle; and for at least one of the angles to be greater than 90° so as to result in a V-shaped groove geometry or so that the groove is U-shaped in cross section. This allows consideration of the fact that the bit holder becomes worn away with increasing wear. Changes in the force situation at the bit holder occur as a result, and can be taken into account with the groove geometries.

In addition, the widening groove geometry has production advantages in terms of reliable introduction of the weld.

A bit holder according to the present invention can also, in particular, be such that two or more grooves that run concentrically with respect to the longitudinal center axis of the bit receptacle are machined into the bit supporting surface; or that the weld or welds has/have regions having a different radial extension with reference to the longitudinal center axis of the bit receptacle. This feature allows wear that is inhomogeneous as a result of utilization to be counteracted. This effect can also be achieved, for example, with a bit holder which is such that the weld or welds has/have regions that assume different radial spacings from the longitudinal center axis of the bit receptacle.

One possible inventive alternative can be such that one or more grooves are embodied as radial grooves and are arranged set back with respect to the bit supporting surface.

As a result of the set-back arrangement, the bit supporting surface remains uninfluenced when the weld is produced. The radial groove can preferably be arranged in such a way that it can be looked into from outside and thus, as a wear marker, allows the wear status to be detected.

The invention will be further explained below with reference to exemplifying embodiments depicted in the drawings, in which.

Figure 14:
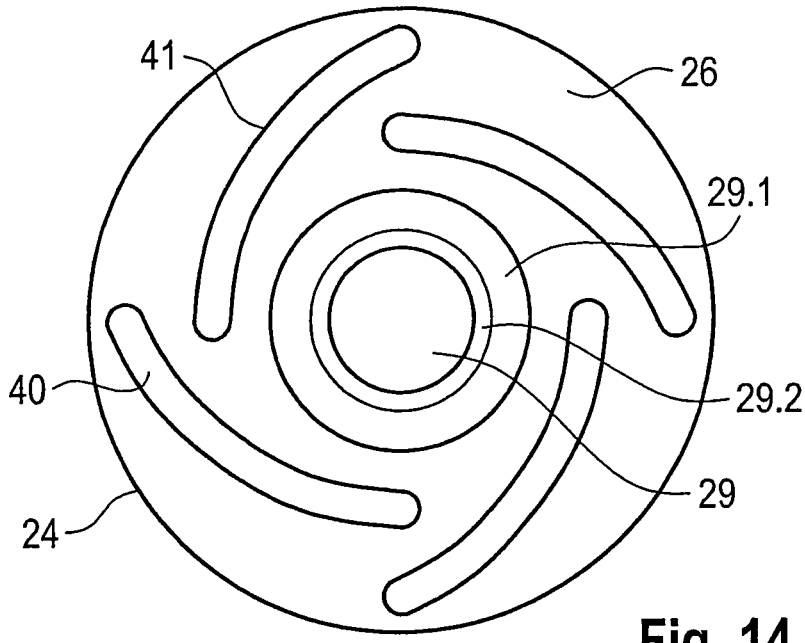
Figure 15:
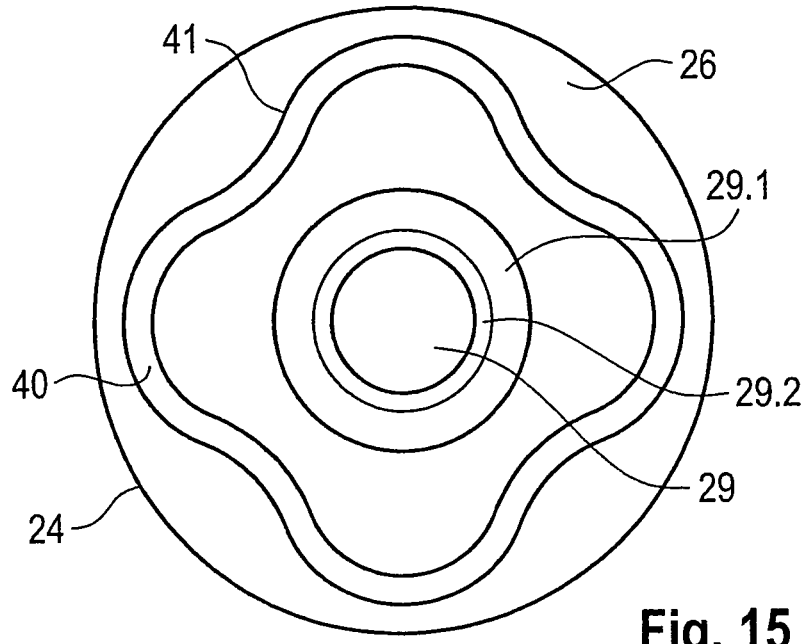

FIGS. 14 and 15 each show a plan view of a bit supporting surface of a bit holder according to the present invention.

Figure 1:
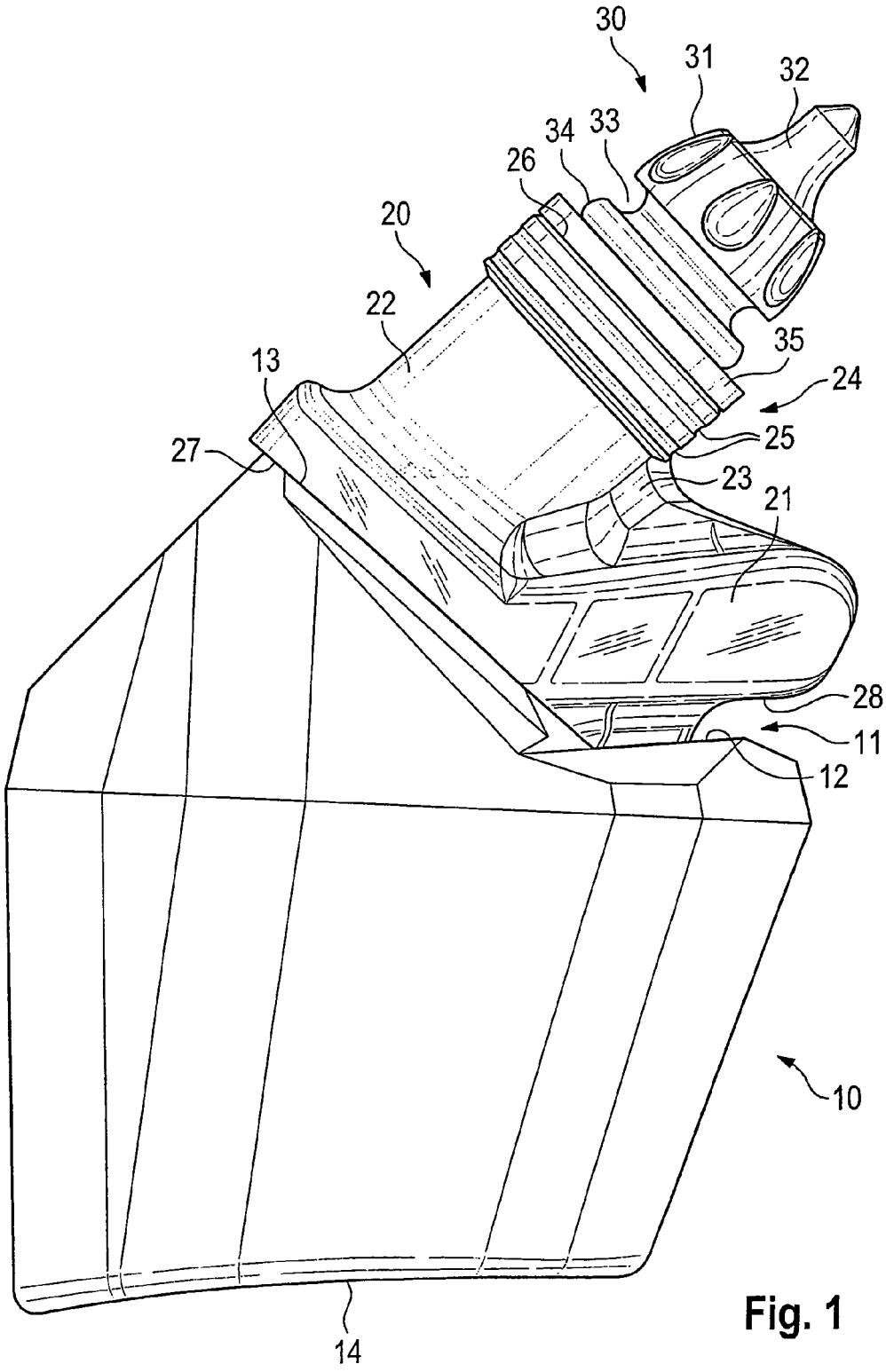
FIG. 1 is a lateral view of a bit holder changing system having a base part, a bit holder, and a bit.
Figure 2:
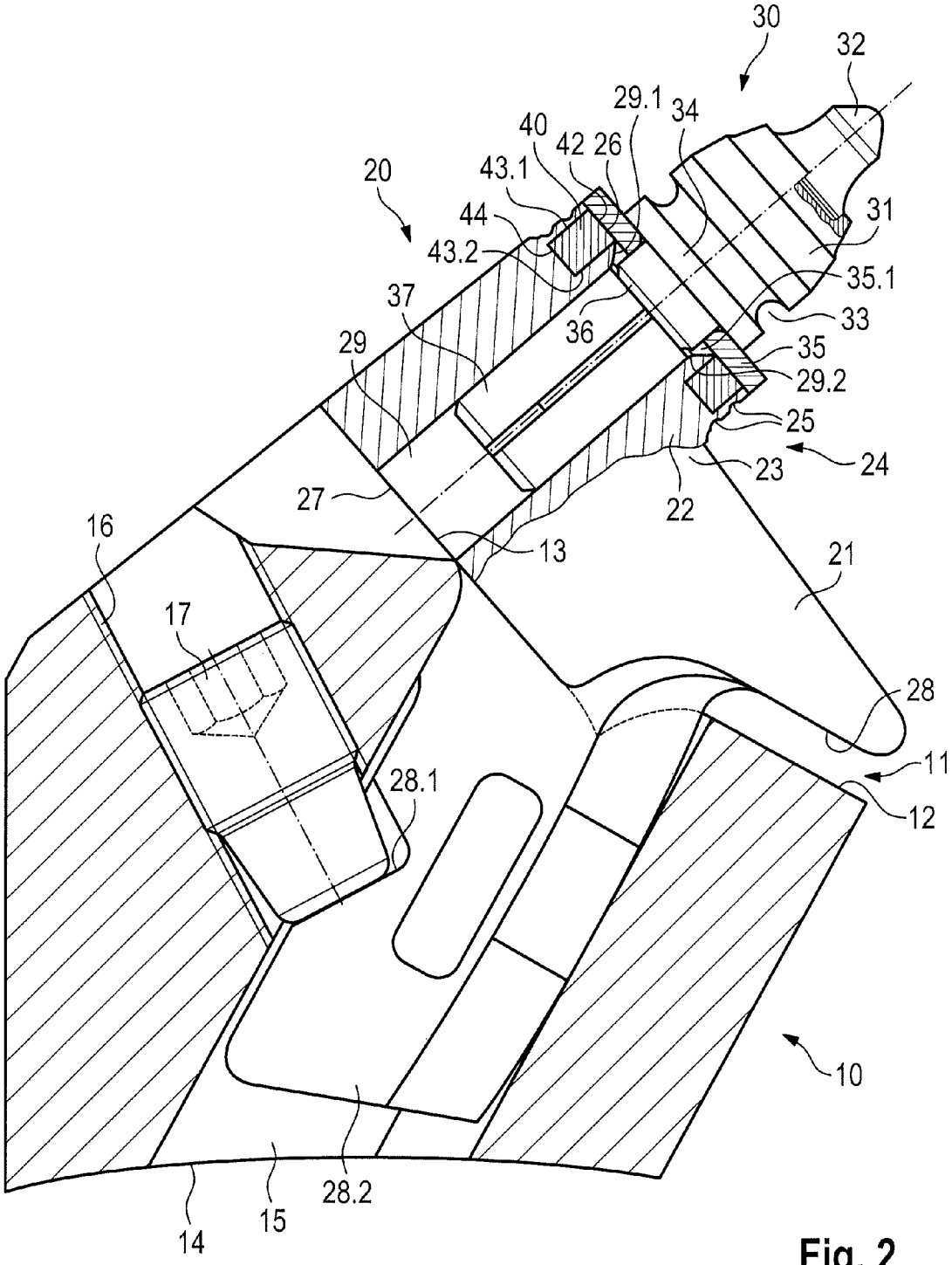
FIG. 2 is a lateral view and vertical section of the bit holder changing system according to FIG. 1.
Figure 3:
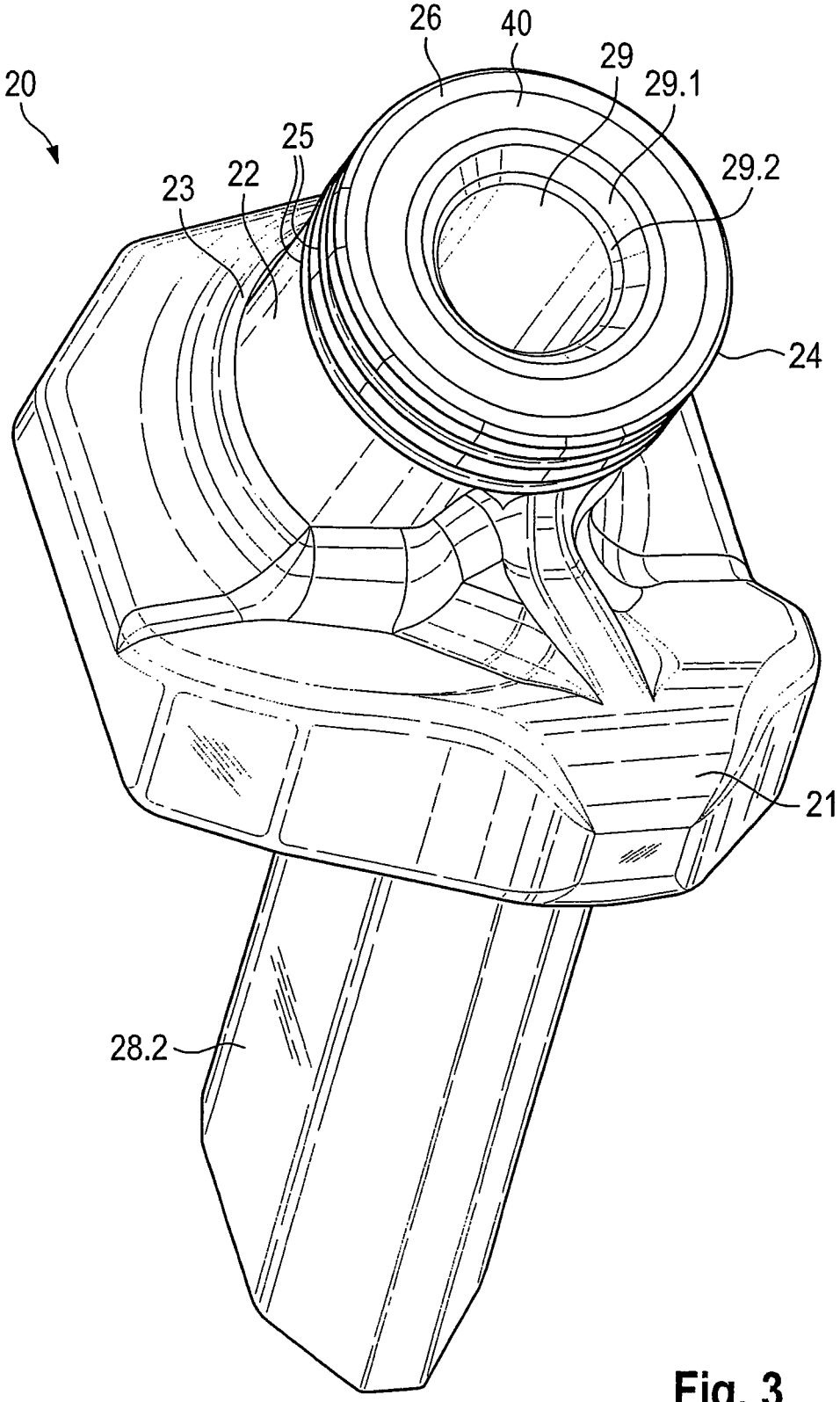
FIG. 3 is a perspective front view of the bit holder shown in FIGS. 1 and 2.

FIGS. 1 and 2 show a bit holder changing system having a base part 10, a bit holder 20, and a bit 30.

As is evident from FIG. 2, base part 10 comprises a shank receptacle 15 that, proceeding from a shoulder 12 or a bottom surface 14, is machined into base part 10 as an opening.

A stop surface 13 adjoins shoulder 12 at an angle. With bottom surface 14, base part 10 can be placed onto the outer periphery of a milling drum tube (not depicted) of a road milling machine. Base part 10 is welded to the milling drum tube. Opening into shank receptacle 15 oppositely to the tool feed direction is a threaded receptacle 16 into which a compression screw 17 can be screwed.

Compression screw 17 serves to secure bit holder 20. Bit holder 20, which may also be referred to as a bit holder body 20, comprises a skirt 21 that is coupled integrally to a connecting segment 23. Connecting segment 23 carries an extension 22 that comprises a cylindrical segment 24 projecting beyond skirt 21. Extension 22 and cylindrical segment 24 are penetrated by a bit receptacle 29 in the shape of a through bore.

Cylindrical segment 24 forms, at its free end, a bit supporting surface 26 that extends annularly and concentrically about the longitudinal center axis of bit receptacle 29. As is further evident from FIG. 2, bit receptacle 29 transitions via an insertion bevel 29.2 and a centering bevel 29.1 into bit supporting surface 26. Centering bevel 29.1 widens the bit receptacle 29 in V-shaped fashion. Cylindrical segment 24 carries two wear markings 25. These are cut into the outer contour of cylindrical segment 24 as annularly extending grooves, and are held spaced away parallel to bit support surface 26.

A recess 41 of substantially square or rectangular cross section is machined into bit supporting surface 26. This recess 41 can be generated, by mechanical machining (drilling, lathe-turning, milling), as a groove extending in annular and concentric fashion about the longitudinal center axis of bit receptacle 29. This groove forms a bottom surface 44 that runs parallel to bit supporting surface 26. Groove side walls 43.1 and 43.2 adjoin bottom surface 44 at a right angle. Groove side walls 43.1 and 43.2 are set so that they are held at a distance from bit receptacle 29 (and from insertion bevel 29.2 and centering bevel 29.1) and from wear markings 25.

These surfaces therefore remain mechanically uninfluenced. A weld 40 is introduced into recess 41. It completely fills up recess 41; an exposed surface 42 of weld 40 is formed oppositely from bottom surface 44, which surface terminates flush with bit supporting surface 26.

Recess 41 and its arrangement are selected so that the surfaces that are particularly important for correct initial functioning of the overall system made up of bit 30 and bit holder 20, such as bit receptacle 29, insertion bevel 29.2, centering bevel 29.1, and bit supporting surface 26, are not formed from the weld and are not influenced thereby in functional terms.

During operational use, parts of bit holder 20 may then be worn away as a result of wear, and weld 40 may thereby be locally exposed. This then happens, however, in such a way that weld 40 is rubbed away so that it can take over the work of the aforesaid functional surfaces without causing any tool impairment. The bore exit of bit receptacle 29, located opposite weld 40, opens into a countersurface 27. An insertion extension 28.2 is shaped onto bit holder 20 in the transition region from countersurface 27 to skirt 21. With this insertion extension 28.2, bit holder 20 can be introduced into insertion receptacle 15 of base part 10. The introduction motion is limited by stop surface 13, against which countersurface 27 comes to a stop.

In order to secure bit holder 20 in base part 10, compression screw 17 is screwed into threaded receptacle 16 until it clamps against a compression surface 28.1 of insertion extension 28.2. In the assembled state, a resetting space 11 is formed between an underside 28 of bit holder 20 and shoulder 12 of base part 10.

A bit 30, in the present case a point-attack bit, can be installed into bit receptacle 29. The point-attack bit comprises a bit head 31 and a bit shank 36 shaped thereonto. A longitudinally slotted clamping sleeve 37 is held in axially lossproof but radially freely rotatable fashion on bit shank 36.

Bit head 31 is equipped with a cup-shaped receptacle in which a bit tip 32 made of hard material is secured. Machined into the rotationally symmetrical bit head 31 is a circumferentially extending pullout groove 33 that is delimited on the shank side by a collar 34.

Bit shank 36 carries, in the transition region to bit head 31, a wear washer 35 that is embodied in rotationally symmetrical fashion and is equipped, on its side facing away from bit head 31, with a conically tapering centering collar 35.1. The outside diameter and inside diameter of wear washer 35 and cylindrical segment 24 approximately correspond to one another. Centering collar 35.1 of wear washer 35 and centering bevel 29.1 of bit receptacle 29 likewise correspond to one another in order to ensure proper function, i.e. unimpeded bit rotation, of the overall system during use.

Bit 30 is inserted into bit receptacle 29 in such a way that it is held therein by means of the clamping action of clamping sleeve 37. In this context, wear washer 35 rests on bit supporting surface 26 and on exposed surface 42 of weld 40. Bit head 31 is braced against the opposite side of wear washer 35.

Because of the unavoidable bit rotation during operational use, wear washer 35 grinds over exposed surface 42 and bit supporting surface 26 and wears them away. Be it noted in this connection that only minimal abrasion phenomena occur for each life cycle of a bit 30.

Rapid wear is counteracted in particular by weld 40; the particular wear conditions of each individual application can be reacted to by selecting the filler metal material.

Cylindrical segment 24 is nevertheless worn away over time; the wear status can be ascertained visually by way of the location of bit supporting surface 26 with respect to wear marking 25. Once the second wear marking 25 has been reached, bit holder 20 must be replaced.

Figure 9:
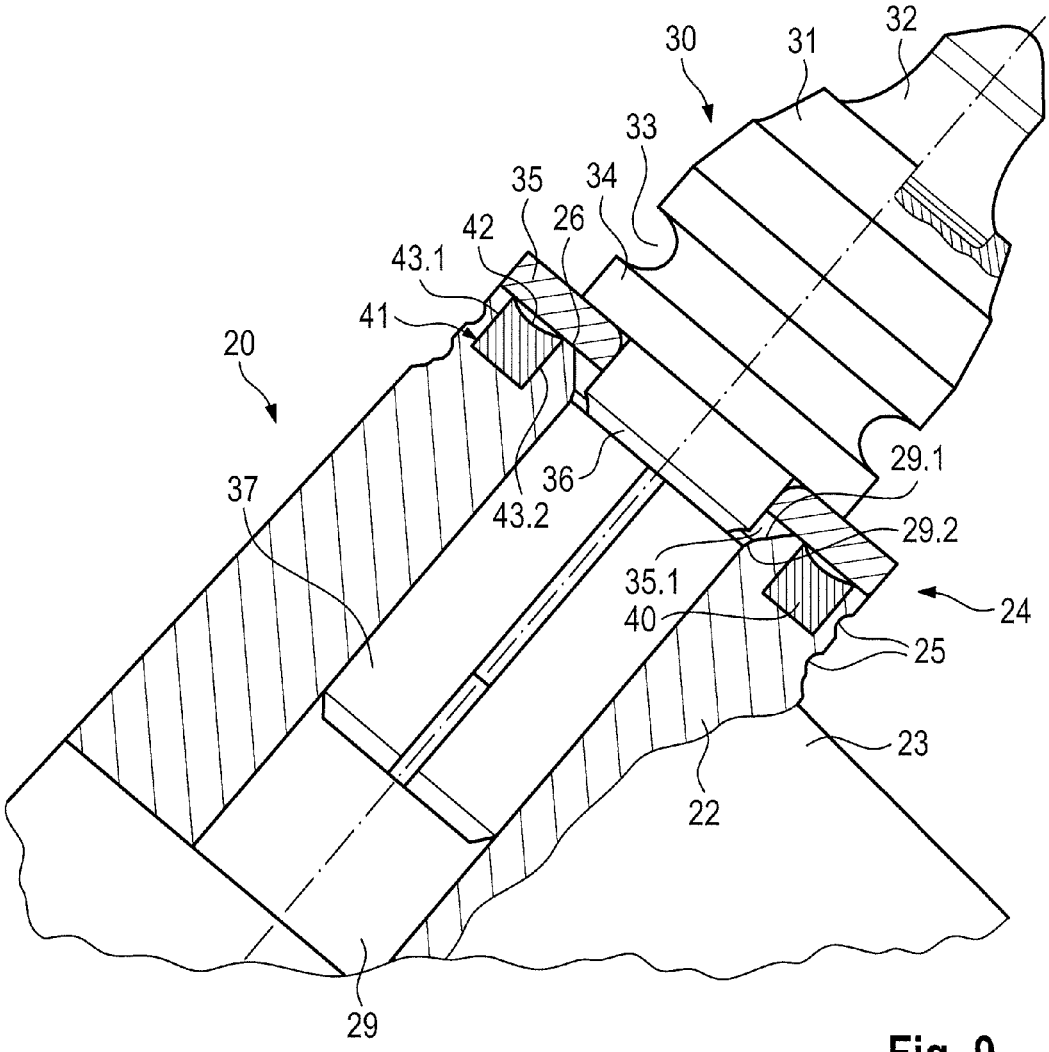

It is evident from FIG. 9 that weld 40 extends concentrically about the longitudinal center axis of bit receptacle 29.

Figure 4:
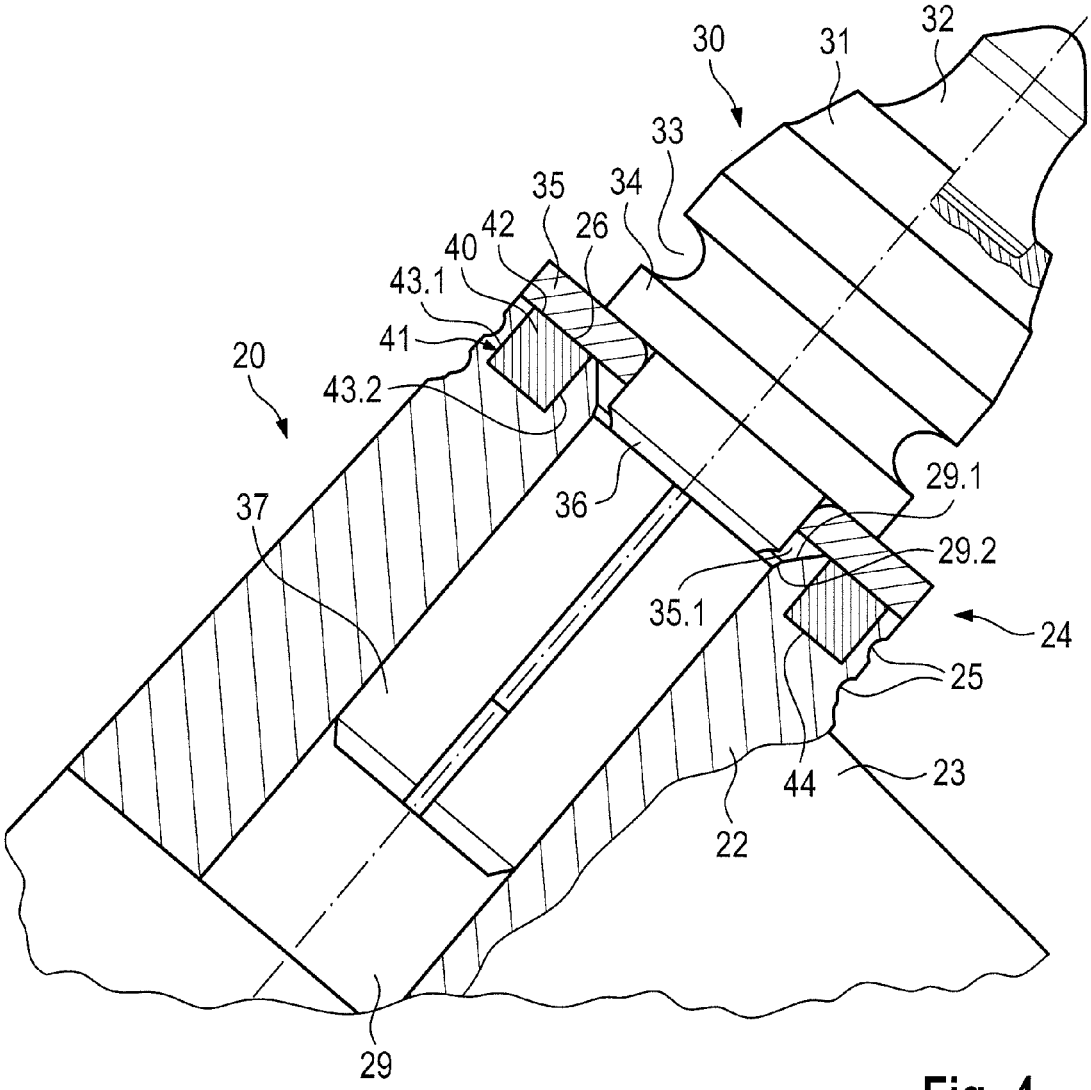
FIG. 4 is an enlarged detail depiction of the bit holder according to FIG. 3, in a side view and in section.

Weld 40 is more clearly evident at enlarged scale in FIG. 4. Recess 41 is recessed sufficiently into bit holder 20 that bottom wall 44 extends approximately as far as the level of the lower wear marking 25. Wear protection is thereby ensured over practically the entire life span of bit holder 20.

FIGS. 5 to 13 show bit holders 20 that correspond to bit holders 20 according to FIGS. 1 to 4. They differ only in terms of the conformation of recess 41 and weld 40.

Figure 5:
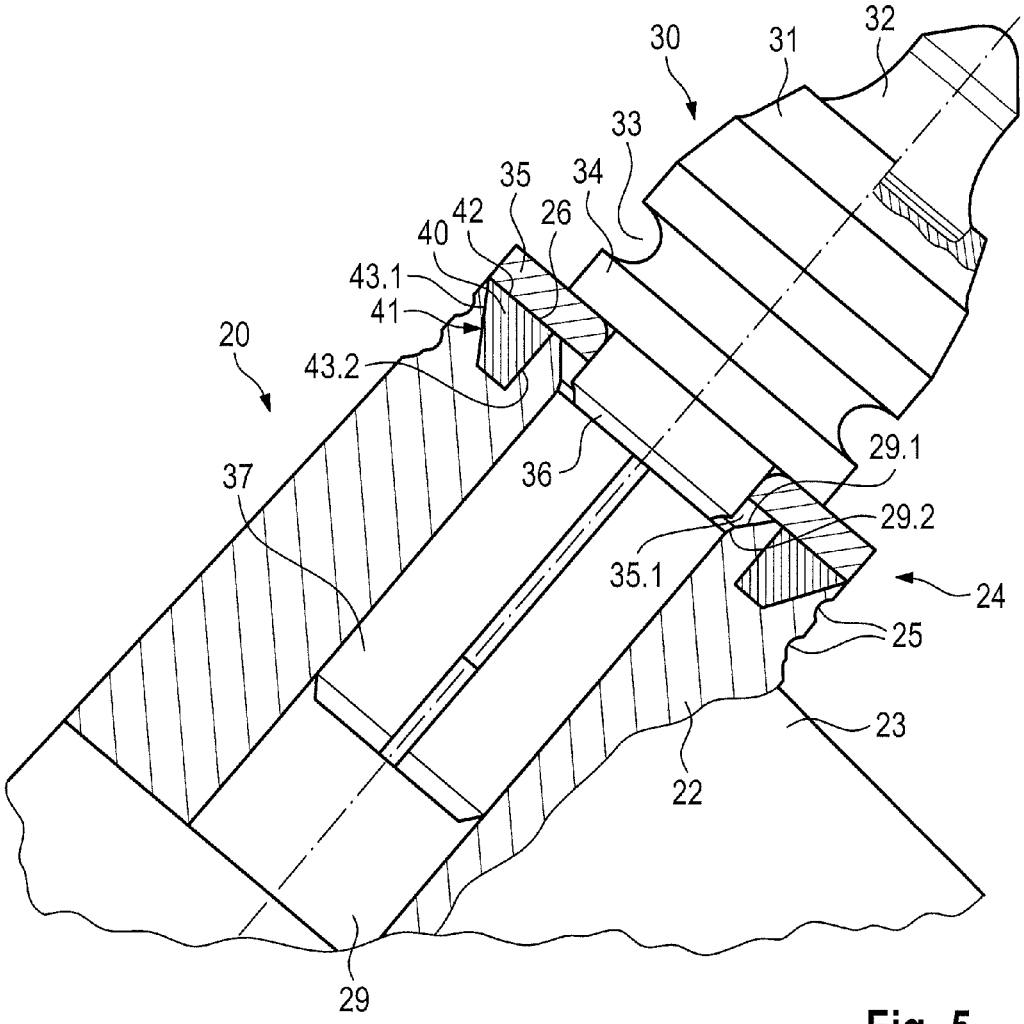
FIGS. 5 to 13 show further variant embodiments of bit holders according to FIG. 3, in a side view and in section.

According to FIG. 5, groove side walls 43.1, 43.2 of recess 41 are set in a V-shape with respect to one another, groove side wall 43.2 being axially parallel to the longitudinal center axis of bit receptacle 29.

Figure 6:
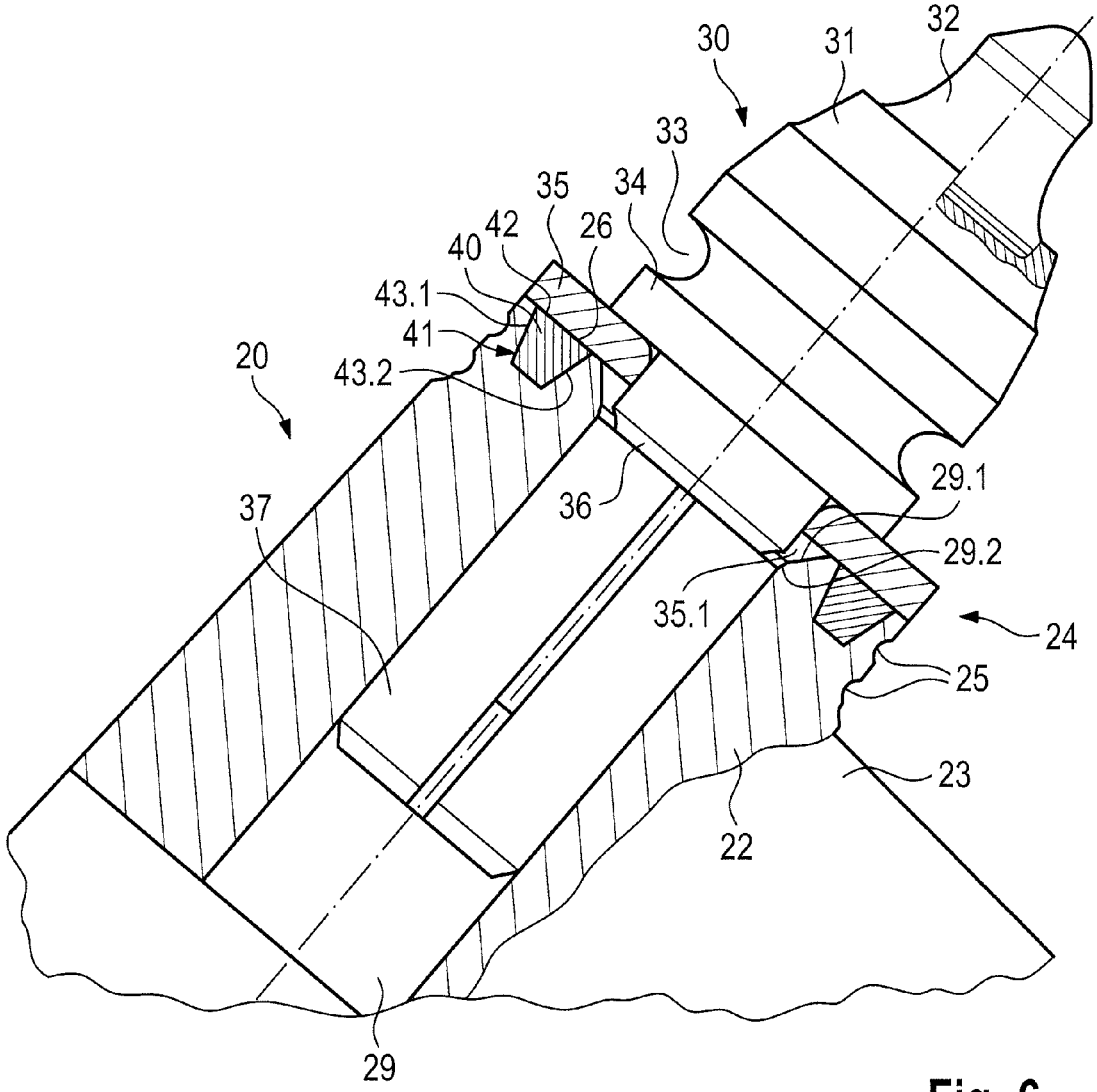

FIG. 6 shows a symmetrical V-shaped groove conformation, the opening angle (incidence of a groove side wall 43.1, 43.2 with respect to the bottom wall) preferably being selected to be greater than 90° in order make the weld particularly easy to produce.

Figure 7:
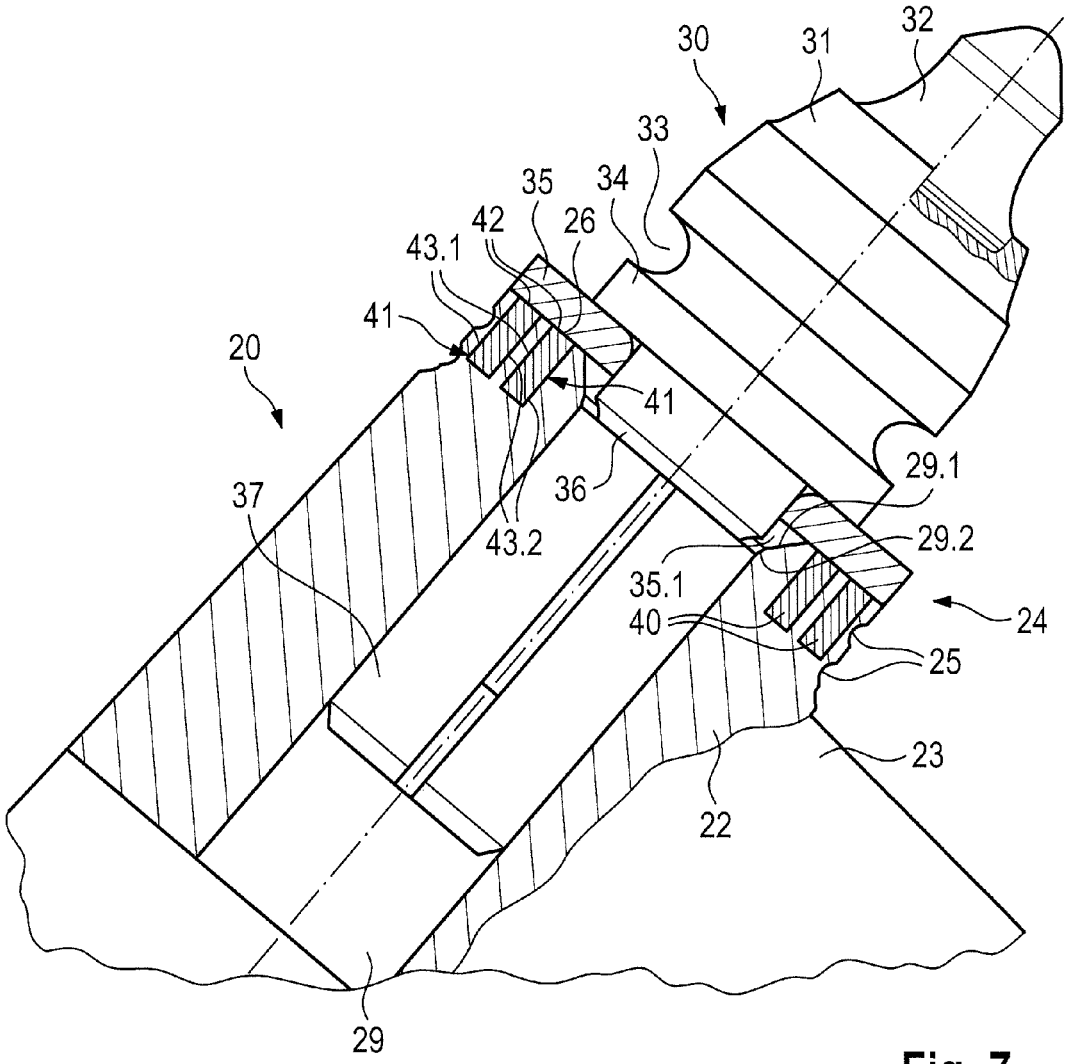

According to the exemplifying embodiment in FIG. 7, two annular welds 40 extending concentrically about the longitudinal center axis are used. Welds 40 are substantially analogous in configuration to weld 40 according to FIG. 4.

Figure 8:
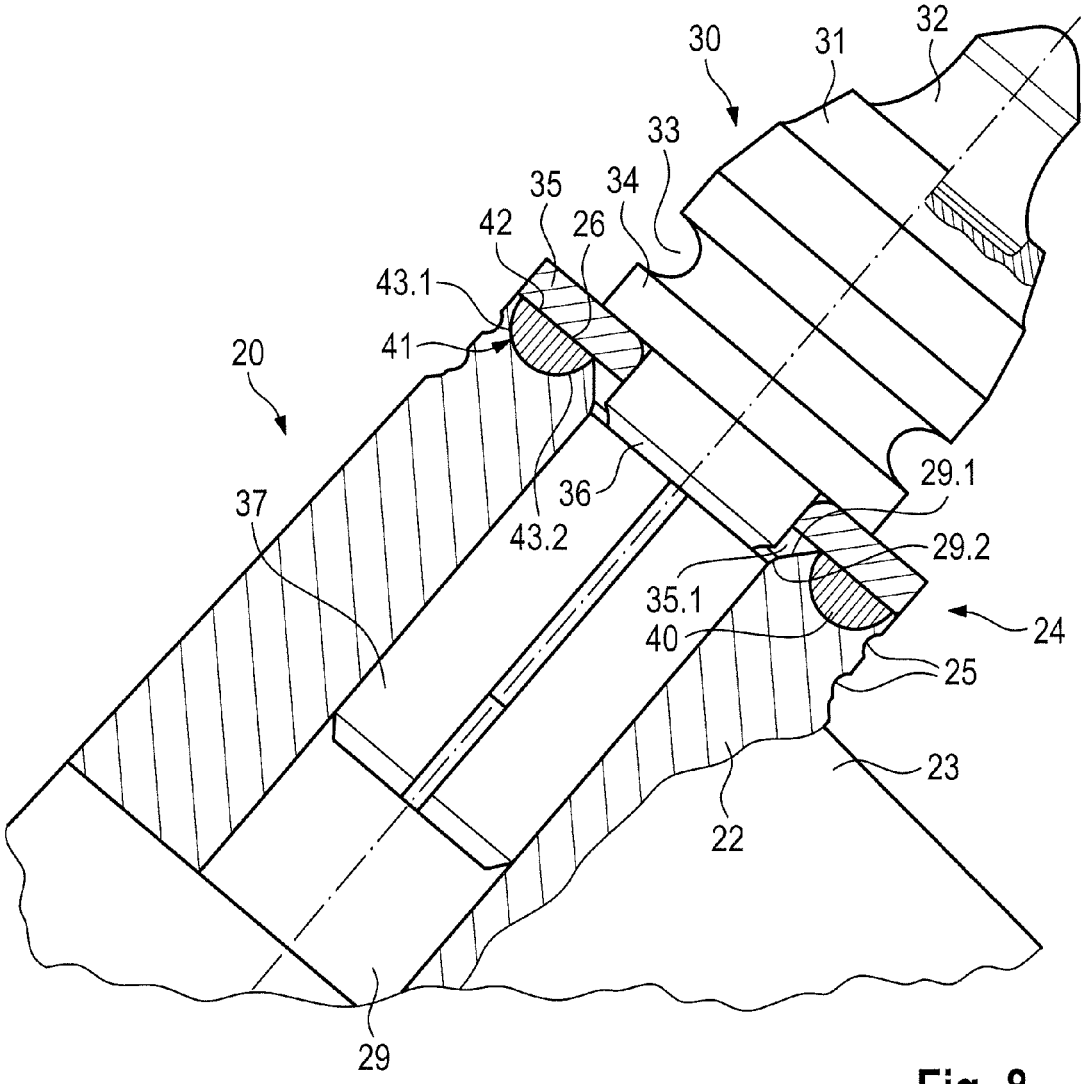

FIG. 8 illustrates an annularly extending groove as recess 41, which is semicircular or partly circular in cross section. This recess 41 is particularly easy to fill with weld 40.

Whereas in the case of the exemplifying embodiments according to FIGS. 1 to 8, exposed surface 42 of weld 40 always terminates flush with bit supporting surface 26, FIG. 9 illustrates the fact that all welds 40 can also have an exposed surface 42 that is set back with respect to bit supporting surface 26.

Figure 10:
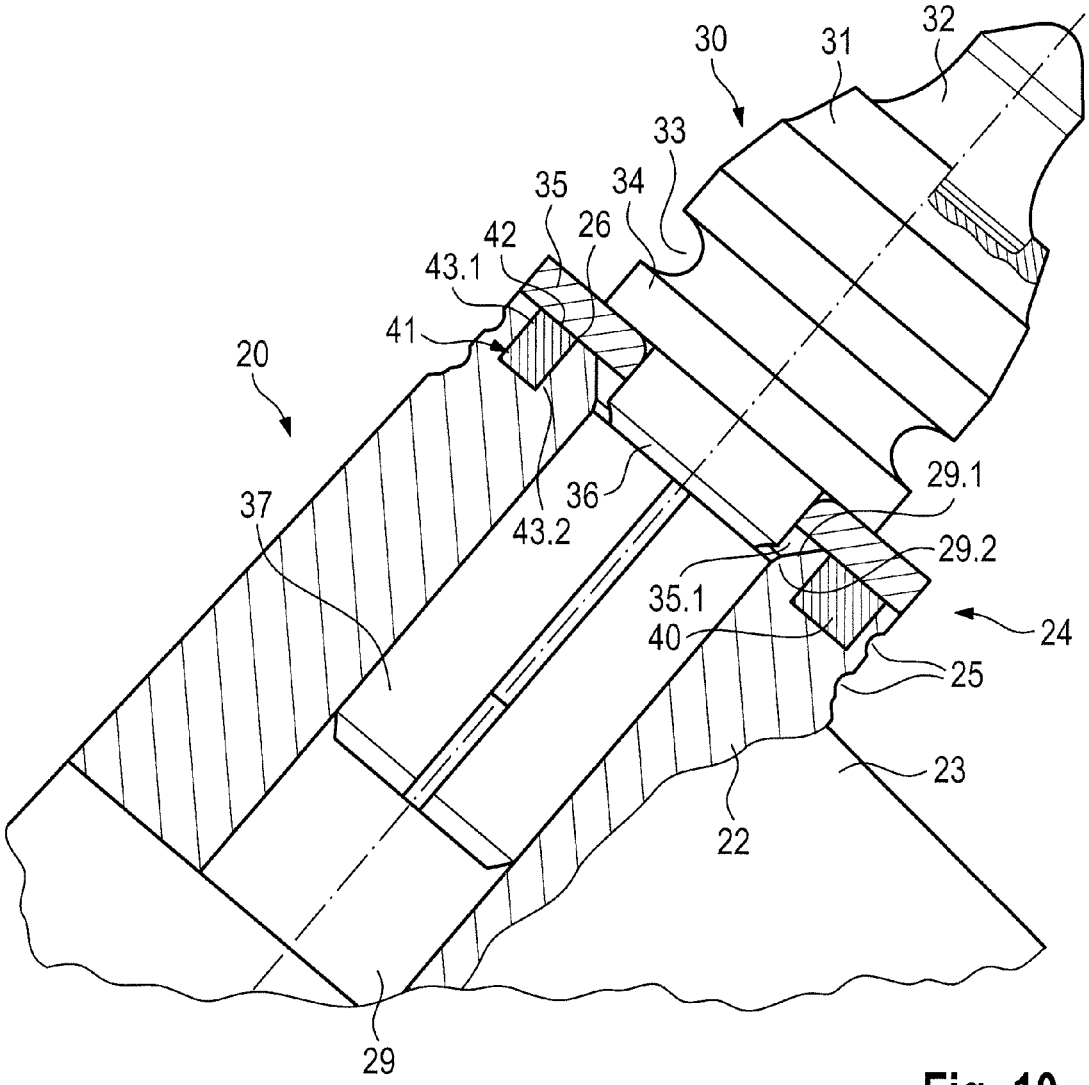

FIG. 10 shows a weld that is once again embodied in the form of a circumferentially extending ring. The ring width in the radial direction is, however, varied in a radial direction in order to constitute a wear protection element matched to differing load intensities.

Figure 11:
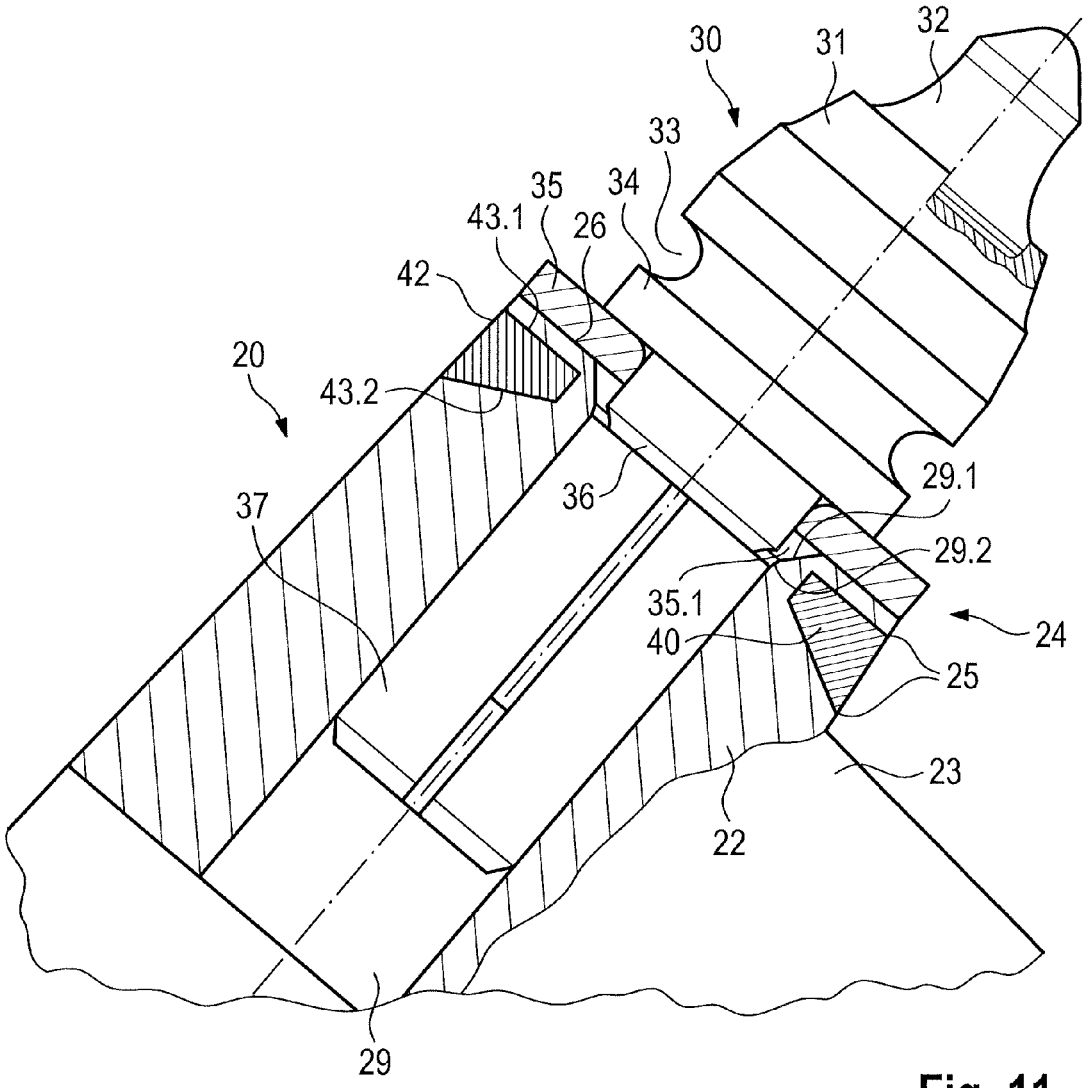
Figure 12:
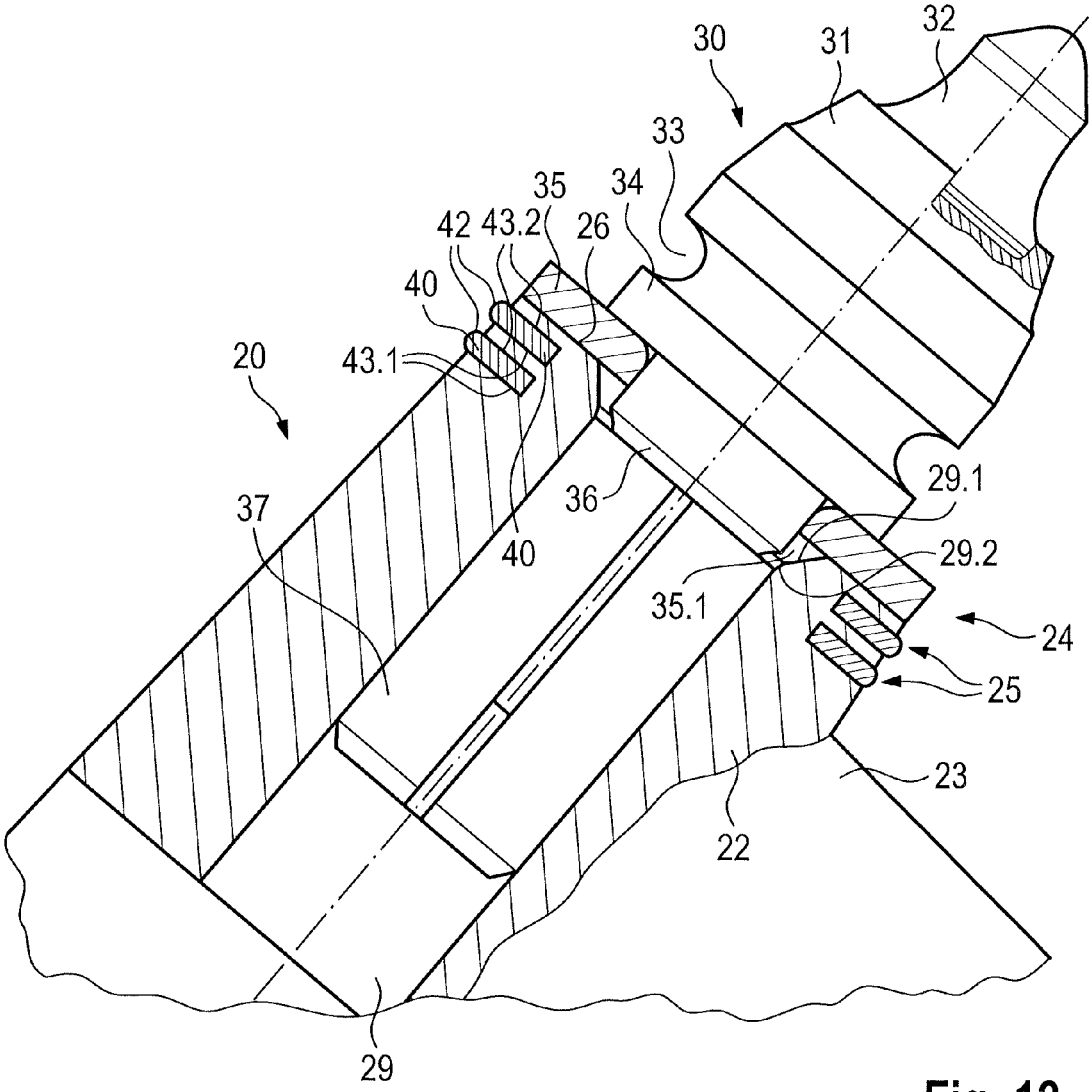

FIGS. 11 and 12 show the use of recesses 41 in the shape of radial grooves. These are cut radially into the cylindrical outer surface of cylindrical segment 24.

In the embodiment according to FIG. 11, upper groove side wall 43.1 is held spaced away in parallel fashion at a distance from bit supporting surface 26, while the other groove side wall 43.2 is set at an angle.

Wear markings 25 are created in the transition region from exposed surface 42 of weld 40 to cylindrical portion 24. If exposed surface 42 is configured by analogy with FIG. 9, wear markings 25 are then readily detectable visually as transitions of the depressed region.

FIG. 12 shows an exemplifying embodiment in which two recesses 41 arranged above one another, having welds 40 introduced thereinto, are used. As the depiction illustrates, in this case welds 40 can form outwardly protruding exposed surfaces 42 in order to make wear markings 25 recognizable.

Figure 13:
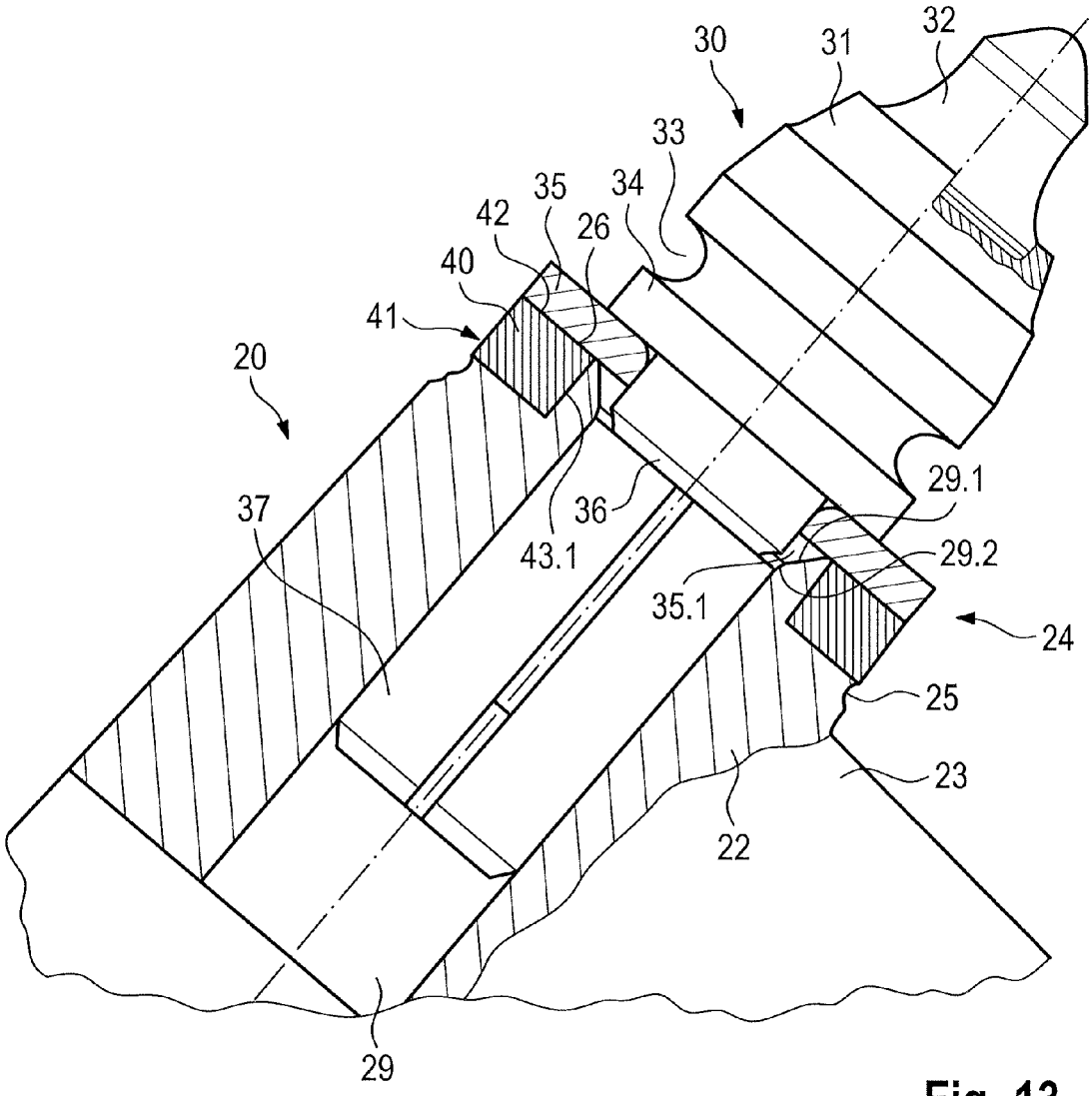

FIG. 13 shows an embodiment which illustrates that recess 41 can be embodied not only in the form of a groove, but also as a cutout.

Instead of circumferentially extending welds 40, it is also possible for point-like, curved, or linear recesses 41 to be provided with welds 40, as depicted by way of example in FIGS. 14 and 15. The only limitation on the shape and arrangement of the recess(es) is that it/they must be produced and then filled again with the weld.

The invention described can be used and easily implemented not only in the context of bit holders 20 shown in the drawings, but also on bit holders 20 configured in any other way.

The invention claimed is:

1. A bit holder, comprising:

a bit holder body having a bit supporting surface defined on the bit holder body and having a bit receptacle defined in the bit holder body, the bit receptacle being communicated with the bit supporting surface at an introduction opening, the bit holder body having a first recess defined entirely in the bit supporting surface; and a first weld at least partially filling the first recess such that the first weld does not extend above the bit supporting surface, the first weld being formed of a uniform continuous filler metal material having a higher resistance to abrasion than does the bit supporting surface, the first weld forming a first wear protection element operably associated with the bit supporting surface so that as the bit supporting surface is worn away the wear protection element is also worn away.

2. The bit holder of claim 1, wherein:

the bit receptacle has a longitudinal center axis; and the first recess is concentric about the longitudinal central axis.

3. The bit holder of claim 2, further comprising:

a second recess formed in the bit supporting surface concentric with the first recess; and a second weld at least partially filling the second recess.

4. The bit holder of claim 1, wherein:

the weld terminates flush with the bit supporting surface.

5. The bit holder of claim 1, wherein:

the weld has an exposed surface set back from the bit supporting surface so that some initial wear of the bit supporting surface occurs before the weld begins to be worn away.

6. The bit holder of claim 1, wherein:

the bit receptacle has a longitudinal center axis; and the first recess includes regions having different radial spacings from the longitudinal center axis.

7. The bit holder of claim 1, wherein:

the first recess includes a bottom wall and two parallel side walls.

8. The bit holder of claim 1, wherein:

the first recess includes a bottom wall and two side walls forming a V-shape cross-section.

9. The bit holder of claim 1, wherein:

the first recess has a semi-circular cross-section.

* * * * *

UNITED STATES PATENT AND TRADEMARK OFFICE

CERTIFICATE OF CORRECTION

PATENT NO. : 8,783,785 B2
APPLICATION NO. : 13/061790
DATED : July 22, 2014
INVENTOR(S) : Lehnert et al.

It is certified that error appears in the above-identified patent and that said Letters Patent is hereby corrected as shown below:

On the title page, item (75) Inventors for Inventor Martin Lenz: replace "Grossmalscheld" with --Grossmaischeid--.

Signed and Sealed this
Twenty-first Day of October, 2014

Michelle K. Lee

Michelle K. Lee
*Deputy Director of the United States Patent and Trademark Office*